US007665821B2

(12) United States Patent
Ito et al.

(10) Patent No.: US 7,665,821 B2
(45) Date of Patent: Feb. 23, 2010

(54) INKJET PRINTER AND MAINTENANCE METHOD THEREOF

(75) Inventors: Shingo Ito, Kasugai (JP); Noritsugu Ito, Tokoname (JP); Naokazu Tanahashi, Nagoya (JP); Wataru Sugiyama, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 494 days.

(21) Appl. No.: 11/690,818

(22) Filed: Mar. 24, 2007

(65) Prior Publication Data

US 2007/0222814 A1 Sep. 27, 2007

(30) Foreign Application Priority Data

Mar. 27, 2006 (JP) ..... 2006-086429

(51) Int. Cl.
*B41J 2/165* (2006.01)

(52) U.S. Cl. ..... 347/23

(58) Field of Classification Search ..... 347/23
See application file for complete search history.

(56) References Cited

U.S. PATENT DOCUMENTS 6,299,277 B1 10/2001 Fujii
6,880,913 B2 * 4/2005 Suzuki ..... 347/23
7,354,132 B2 * 4/2008 Suzuki ..... 347/23

FOREIGN PATENT DOCUMENTS

JP H10-146993 A 6/1998

* cited by examiner

*Primary Examiner*—Julian D Huffman
(74) *Attorney, Agent, or Firm*—Baker Botts L.L.P.

(57) ABSTRACT

In an inkjet printer according to an aspect, a print head includes a nozzle and ejects ink through the nozzle. A maintenance unit performs a maintenance operation to recover an ejection state of the nozzle. A sealing unit selectively exposes and seals the nozzle. A first timer unit measures a sealing time when the sealing unit seals the nozzle. A second timer unit measures an exposing time when the sealing unit exposes the nozzle. A dryness obtaining unit obtains a dryness level of the nozzle based on the sealing time and the exposing time. A limit level storing unit stores a predetermined dryness level as a limit level. A control unit activates the maintenance unit when the obtained dryness level is equal to or above the limit level.

12 Claims, 8 Drawing Sheets

FIG. 4A

22a

| CAP DRYING COEFFICIENT TABLE | |
|---|---|
| VALUE IN UNCAPPED TIME MEMORY | CAP DRYING COEFFICIENT ($\alpha$) |
| 0 – 1 | 1 |
| 2 – 9 | 1.2 |
| 10 – 99 | 2 |
| 100 – | 10 |

FIG. 4B

22b

| NOZZLE DRYNESS TABLE | | |
|---|---|---|
| VALUE ($\alpha$) IN DRYING COEFFICIENT STORAGE MEMORY | CAPPED TIME tc (HOURS) | NOZZLE DRYNESS ($\beta$) |
| 1 | tc < 5 | 100 |
| | 5 ≤ tc < 15 | 200 |
| | 15 ≤ tc < 55 | 300 |
| | 55 ≤ tc < 200 | 400 |
| | 200 ≤ tc | 500 |
| 1.2 | tc < 4 | 100 |
| | 4 ≤ tc < 12 | 200 |
| | 12 ≤ tc < 43 | 300 |
| | 43 ≤ tc < 150 | 400 |
| | 150 ≤ tc | 500 |
| 2 | tc < 3 | 100 |
| | 3 ≤ tc < 11 | 200 |
| | 11 ≤ tc < 35 | 300 |
| | 35 ≤ tc < 110 | 400 |
| | 110 ≤ tc | 500 |
| 10 | tc < 2 | 100 |
| | 2 ≤ tc < 9 | 200 |
| | 9 ≤ tc < 28 | 300 |
| | 28 ≤ tc < 85 | 400 |
| | 85 ≤ tc | 500 |

INKJET PRINTER AND MAINTENANCE METHOD THEREOF

CROSS-REFERENCE TO RELATED APPLICATIONS

This application is based upon and claims the benefit of priority from Japanese Patent Application No. 2006-086429, filed on Mar. 27, 2006, the entire contents of which are incorporated herein by reference.

TECHNICAL FIELD

The present invention relates to an inkjet printer and maintenance method thereof.

BACKGROUND

An inkjet printer includes a print head with a plurality of nozzles formed thereon, which performs printing onto a recording sheet (printing medium) by ejecting ink from the nozzles. There is an inkjet printer further includes a head cap that seals the print head when a printing operation is not performed (hereinafter referred to as a non-printing state), which suppresses drying of ink that adheres to the nozzles and maintains the ejecting state of the nozzles. However, even if the nozzles of the print head are sealed with the head cap, ink that adheres to the nozzles dries little by little. Thus, when the non-printing state continues over a long period of time, ink adhering to the nozzles dries, and as a result, the viscosity of the ink increases. Ink with high viscosity clogs up the nozzles, which may causes ejecting failure that the ink is not properly ejected from the nozzles.

U.S. Pat. No. 6,299,277 discloses an inkjet printer that measures a time period over which a print head is in contact with a head cap and regularly removes thickened ink adhering to the print head based on results of the measurement.

However, when the above inkjet printer is in a printing state (during a printing operation), the head cap is separated from the print head, and thus, the head cap is exposed to air and the inside thereof dries. Even if the inkjet printer thereafter goes into the non-printing state again and the nozzles of the print head are sealed with the head cap, since the humidity of the inside of the head cap is reduced due to drying, ink adhering to the nozzles dries quickly. Accordingly, appropriate timing for removing the thickened ink cannot be detected only by measuring the time period over which the print head is in contact with the head cap. This is because the appropriate timing for removing the thickened ink varies depending on the dryness of the inside of the head cap. Shortening an interval between the thickened ink removing operations and performing frequent thickened ink removing operations enable a decrease a possibility of the ejecting failure but lead to an increase of a waste of ink.

SUMMARY

According to an aspect of the invention, there is provided an inkjet printer including: a print head that includes a nozzle and ejects ink through the nozzle; a maintenance unit that performs a maintenance operation to recover an ejection state of the nozzle, the maintenance operation including at least one of ejecting the ink through the nozzle and sucking the ink from the nozzle; a sealing unit that selectively exposes and seals the nozzle; a first timer unit that measures a sealing time when the sealing unit seals the nozzle; a second timer unit that measures an exposing time when the sealing unit exposes the nozzle; a dryness obtaining unit that obtains a dryness level of the nozzle based on the sealing time and the exposing time; a limit level storing unit that stores a predetermined dryness level as a limit level; and a control unit that activates the maintenance unit when the obtained dryness level is equal to or above the limit level.

According to another aspect of the invention, there is provided a maintenance method of an inkjet printer including: a print head that includes a nozzle and ejects ink through the nozzle; and a sealing unit selectively exposing and sealing the nozzle, the maintenance method including: measuring a sealing time when the sealing unit seals the nozzle; measuring a exposing time when the sealing unit exposes the nozzle; obtaining a dryness level of the nozzle based on the sealing time and the exposing time; performing a maintenance operation to recover an ejection state of the nozzle when the obtained dryness level is equal to or above a predetermined dryness level, the maintenance operation including at least one of ejecting the ink through the nozzle and sucking the ink from the nozzle.

BRIEF DESCRIPTION OF THE DRAWINGS

FIG. 4A is a diagram schematically showing a configuration of a cap drying coefficient table;

FIG. 4B is a diagram schematically showing a configuration of a nozzle dryness table;

DESCRIPTION

Figure 1:
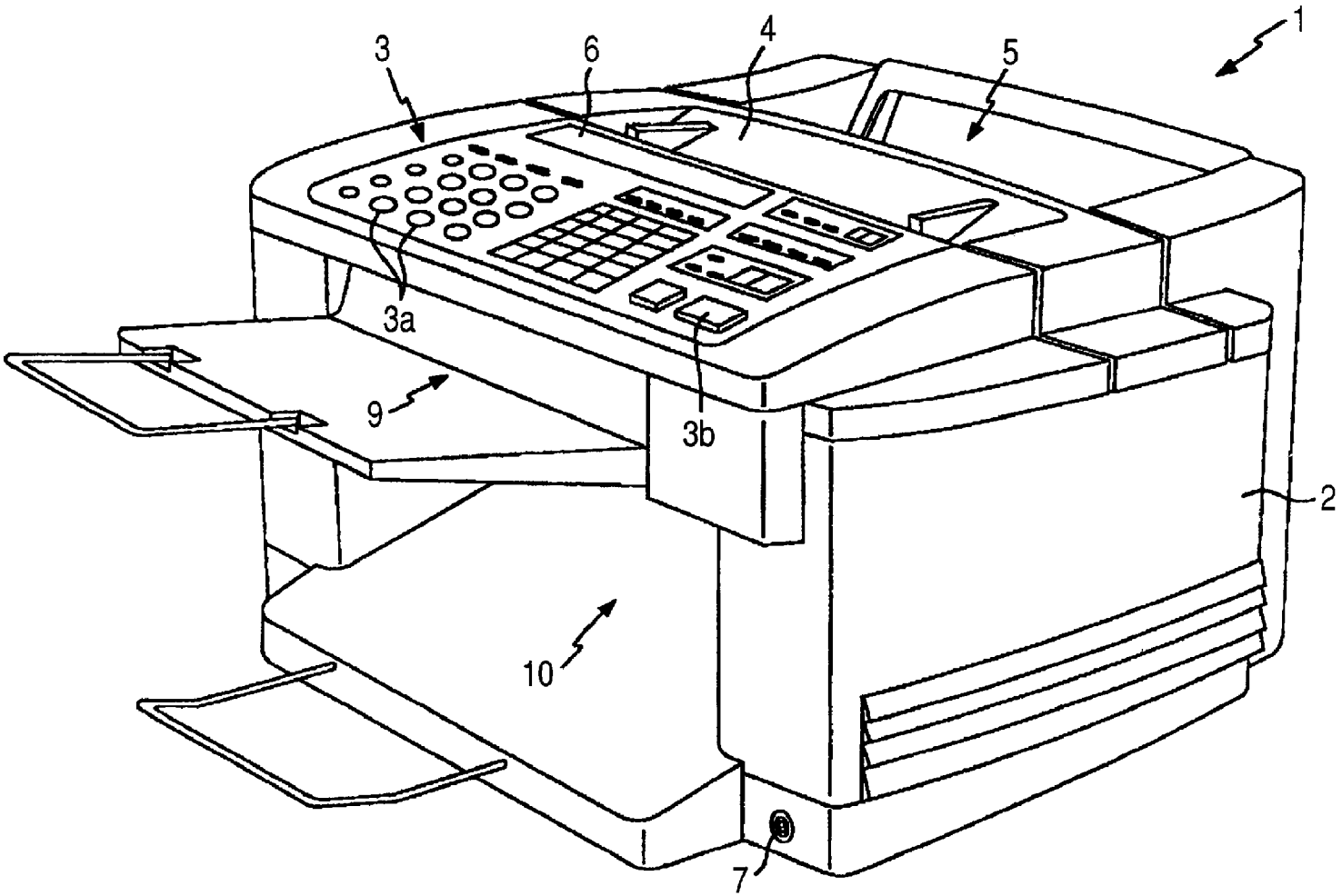
FIG. 1 is a perspective view of a multifunction peripheral device according to one example of the present invention.

An example of the present invention will be described with reference to the accompanying drawings. FIG. 1 is a perspective view of a multifunction peripheral device 1 according to one example of the invention. The multifunction peripheral device 1 has various functions that include a facsimile function, a printer function, a scanner function, a copy function and a video printer function. The multifunction peripheral device 1 includes an inkjet printer 29 (see FIG. 2) capable of performing full color printing for performing a printing operation when at least one of the above functions is performed.

As shown in FIG. 1, a main body 2 of the multifunction peripheral device 1 has a box shape and includes an operation panel 3 arranged at the top front thereof. On the operation panel 3, various buttons such as number buttons 3*a* of "0" to "9" and a start button 3*b* are provided. By pressing these buttons, various operations are performed. Also, operating these buttons enables an initial setting for time to be timed by a timer circuit 28 and numerical value settings for a flushing interval memory 24*a* and a dryness limit value memory 24*b* (see FIG. 3; described later).

A liquid crystal display (hereinafter, referred to as the "LCD") 6 having rectangular shape is provided at the rear of the operation panel 3. The LCD 6 displays thereon the setting state of the multifunction peripheral device 1, various operation messages, or the like. When the multifunction peripheral device 1 is in a standby state, time that is set via the operation panel 3 is displayed on the LCD 6.

At the rear (the right side in FIG. 1) of the LCD 6, a document placing portion 4 is provided to place thereon a document, such as a facsimile document to be transmitted to a destination party's facsimile device 51 (see FIG. 3) upon performing the facsimile function, copy documents to be copied upon performing the copy function, or the like, and a plurality of sheets of the document can be stacked on the document placing portion 4. The document placed on the document placing portion 4 is conveyed into the main body 2 and images recorded on a surface of a sheet in the document is read by a scanner 19 (see FIG. 3). The document whose image have been read is further conveyed and discharged onto a document discharge portion 9 provided below the operation panel 3.

A cassette mounting portion 5 is provided at the rear of the document placing portion 4. A sheet cassette (not shown) that stores a plurality of recording sheets E (see FIG. 2) in a stacked manner is removably mounted on the cassette mounting portion 5. A recording sheet E is supplied from the sheet cassette placed on the mounting portion 5; subjected to printing by the inkjet printer 29 (described later); and then discharged from a recording sheet discharge portion 10 provided below the document discharge portion 9.

A video signal input terminal 7 is provided at the lower right of the recording sheet discharge portion 10. A video signal to be outputted from a video camera or the like which is connected to the video signal input terminal 7 is taken into the multifunction peripheral device 1 and full color printing is performed by the inkjet printer 29.

Figure 2:
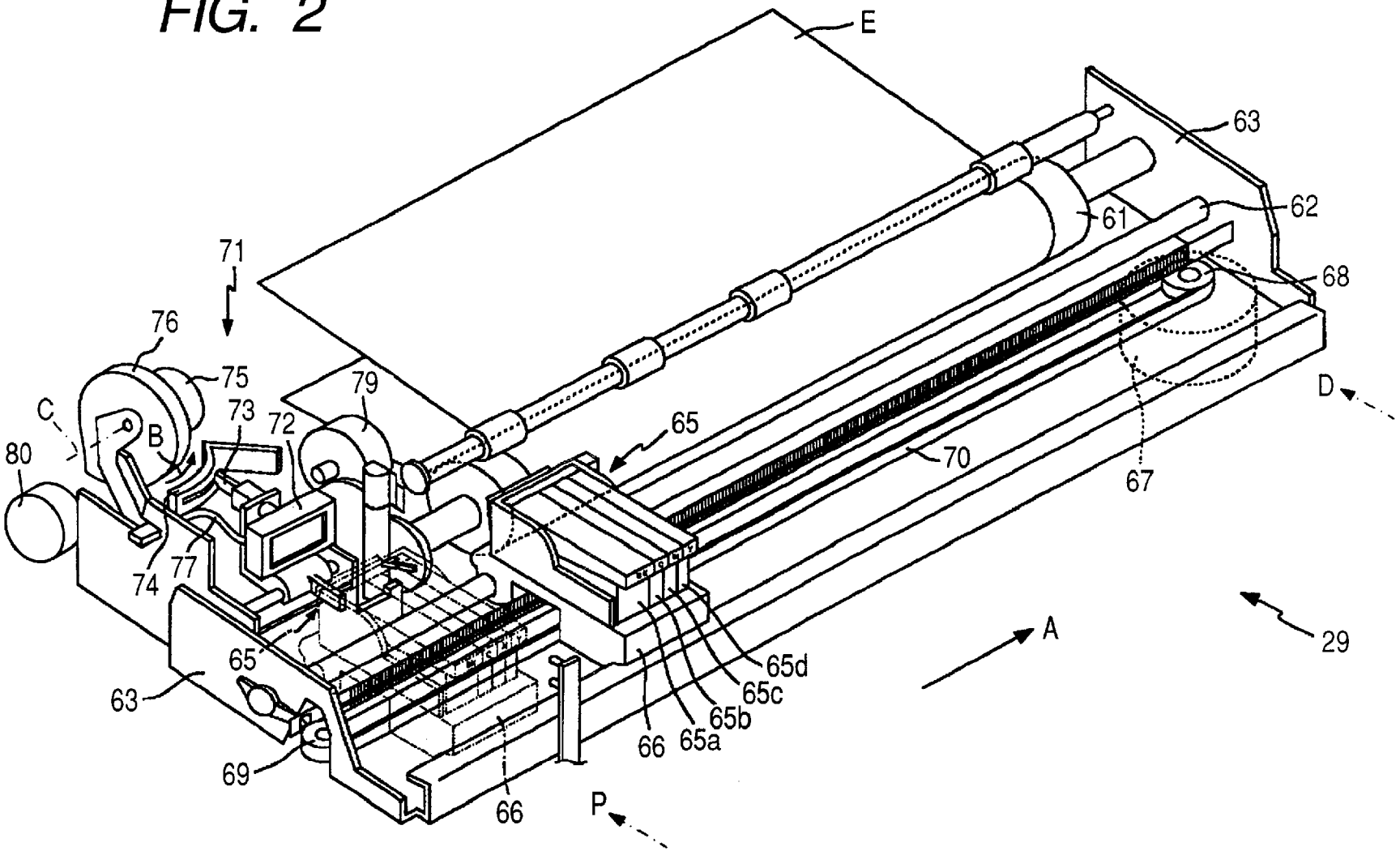
FIG. 2 is a perspective view of an inkjet printer housed in a main body of the multifunction peripheral device.

Next, the inkjet printer 29 will be described with reference to FIG. 2. FIG. 2 is a perspective view of the inkjet printer 29 housed in the main body 2 of the multifunction peripheral device 1 according to the example. The inkjet printer 29 of this example is a serial printer that performs printing operation by moving a print head 65 in a direction indicated by an arrow A in FIG. 2 and a direction opposite the arrow A.

As shown in FIG. 2, the inkjet printer 29 includes a frame 63 having substantially C-shape. A cylindrical platen roller 61 is attached to the frame 63 and rotatable about a center axis of the cylindrical platen roller 61. The platen roller 61 is driven by a conveying motor 79 interlocking with the platen roller 61 and thereby rotates to convey a recording sheet E. A guide rod 62 having linear bar shape is provided parallel to the platen roller 61 and secured to the frame 63. A carriage 66 having the print head 65 mounted thereon is provided on the guide rod 62. The carriage 66 is moved by a carriage motor 67 via a belt 70 along the guide rod 62 in the direction indicated by the arrow A in FIG. 2 and the direction opposite the arrow A. The belt 70 runs between a moving pulley 68 and a follower pulley 69, and the moving pulley 68 is rotated by the carriage motor 67 provided at one side of the frame 63.

The print head 65 mounted on the carriage 66 has four color ink cartridges 65*a* to 65*d*. In the ink cartridges 65*a* to 65*d*, in order from the left in FIG. 2, four color inks including black, cyan, magenta and yellow are filled, respectively. The four color inks are ejected from a plurality of nozzles (not shown) provided in a surface of the print head 65 facing the recording sheet E, whereby full color printing is performed onto the recording sheet E. The ink cartridges 65*a* to 65*d* are individually removable, which enables a replacement for only the ink cartridges 65*a* to 65*d* that have a shortage of ink.

A recovery mechanism 71 is provided at the other side (the left side in FIG. 2) of the frame 63 and performs a periodic purging process (S24 in FIG. 6) in which ink is sucked from the nozzles of the print head 65 to recover the ejecting state of the nozzles. The recovery mechanism 71 includes a suction cap 72 that has substantially rectangular parallelepiped shape and seals the nozzles at one time in a non-printing state to suppress drying of the nozzles of the print head 65. A projection member 73 is attached to the back of the suction cap 72 and causes the suction cap 72 to be projected in a direction of the print head 65. One end of the projection member 73 abuts against a surface of a projection lever 74 formed in an arc shape. When the projection lever 74 is moved in the direction of the print head 65 from the state shown in FIG. 2, the suction cap 72 together with the projection member 73 are projected in the direction of the print head 65. Accordingly, the suction cap 72 is put on and seals the nozzles of the print head 65 by moving the carriage 66 to a position indicated by an arrow P in FIG. 2 (hereinafter, referred to as the "position P") and then moving the projection lever 74 in the direction of the print head 65.

The projection lever 74 is moved in the direction of the print head 65 by rotating a cam body 76 that is driven by a capping motor 75. By driving the capping motor 75 to allow the cam body 76 to rotate about an axis center C of the cam body 76 in a direction indicated by an arrow B in FIG. 2, the cam body 76 presses the projection lever 74 and causes the projection lever 74 to move in the direction of the print head 65.

A tube 77 is connected to a non-suction surface (a portion except the area facing the nozzles at the periodic purge process) of the suction cap 72. The tube 77 is connected to a suction pump (not shown). The suction pump is driven and activated by a purge motor 80. When the suction pump is activated with the suction cap 72 being put on the print head 65, ink is sucked from the nozzles of the print head 65.

For another method of recovering the ejecting state of ink, a periodic flushing process (S27 in FIG. 6) may be performed. The periodic flushing process includes ejecting ink from the nozzles of the print head 65, after moving the carriage 66 to a position indicated by an arrow D in FIG. 2 (hereinafter, referred to as the "position D"). Accordingly, the ejecting state of the nozzles is recovered. The ejected ink is absorbed by an ink absorbing material (not shown) provided to face the print head 65 having been moved to the position D.

Figure 3:
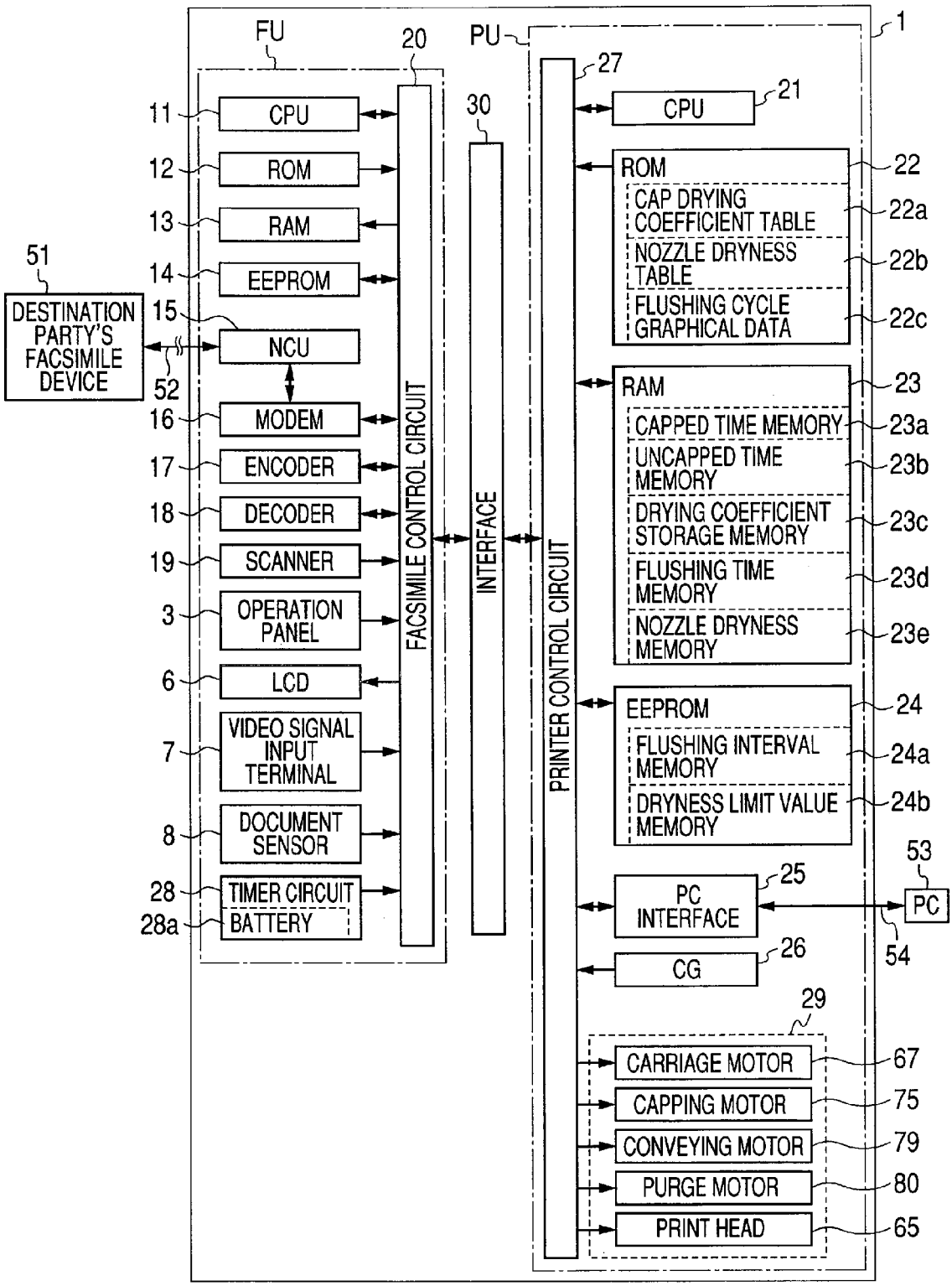
FIG. 3 is a block diagram showing an electrical configuration of the multifunction peripheral device according to the example.

Next, an electrical configuration of the multifunction peripheral device 1 will be described with reference to FIG. 3. FIG. 3 is a block diagram showing the electrical configuration of the multifunction peripheral device 1 according to this example. As shown in FIG. 3, the multifunction peripheral device 1 includes two units, a facsimile unit FU and a printer unit PU, being interconnected by an interface 30. The facsimile unit FU includes a CPU 11, a ROM 12, a RAM 13, an EEPROM 14, a network control unit (hereinafter, referred to as the "NCU") 15, a modem 16, an encoder 17, a decoder 18, the scanner 19, the operation panel 3, the LCD 6, the video signal input terminal 7, a document sensor 8 and the timer circuit 28, which are interconnected via a facsimile control circuit 20.

The CPU 11 controls each unit connected to the facsimile control circuit 20 based on various signals to be transmitted and received via the NCU 15 and thereby performs a facsimile operation. The ROM 12 is a non-rewritable memory that stores therein various control programs to be executed on the multifunction peripheral device 1. The RAM 13 is a rewritable memory for storing various data. The EEPROM 14 is a rewritable nonvolatile memory, which retains data stored therein even after the power of the multifunction peripheral device 1 is turned off.

The NCU 15 performs operations such as sending out a dial signal to a telephone line 52 and responding to a calling signal from the telephone line 52. The modem 16 modulates and demodulates image data via the NCU 15 and transmits the image data to the facsimile device 51 of the destination party. The modem 16 also transmits and receives various procedure signals for transmission control. The encoder 17 performs encoding to compress image data or the like on a document read by the scanner 19. The decoder 18 decodes encoded data such as received facsimile data. The scanner 19 reads an image recorded on a document inserted into the multifunction peripheral device 1 from the document placing portion 4. The above-described operation panel 3, LCD 6, and video signal input terminal 7 is connected to the facsimile control circuit 20. The document sensor 8 detects whether a document is placed on the document placing portion 4.

The timer circuit 28 measures time (including a date) and has a battery 28*a* for continuously timing even after the power to the multifunction peripheral device 1 is turned off. An initial setting for time by the timer circuit 28 is performed via the operation panel 3. Time measured by the timer circuit 28 is output to the LCD 6 when the multifunction peripheral device 1 is on standby, i.e., when each operation function is stopped, whereby time display is performed. The facsimile unit FU is able to communicate with the facsimile device 51 of the destination party via the NCU 15 and the telephone line 52.

The printer unit PU includes a CPU 21 which is a computing unit; a ROM 22 that stores a control program to be executed by the CPU 21, including processes shown in flowcharts in FIGS. 6 to 9 described later; a RAM 23 having various work memories to be referred to and updated upon execution by the CPU 21, a print memory that stores data for printing, and the like; an EEPROM 24 which is a rewritable nonvolatile memory; a personal computer interface (hereinafter, referred to as the "PC interface") 25 to which a personal computer (hereinafter, referred to as the "PC") 53 serving as a main unit is connected; a character generator (hereinafter, referred to as the "CG") 26 that stores vector fonts such as characters for printing; and the inkjet printer 29 described above, which are interconnected via a printer control circuit 27. The PC interface 25 is a Centronics-compatible parallel interface, for example. The multifunction peripheral device 1 can perform transmission and reception of data with the PC 53 via a cable 54 connected to the personal computer interface 25. The printer control circuit 27 is connected to the carriage motor 67, capping motor 75, conveying motor 79, purge motor 80 and print head 65 of the inkjet printer 29.

Figure 5:
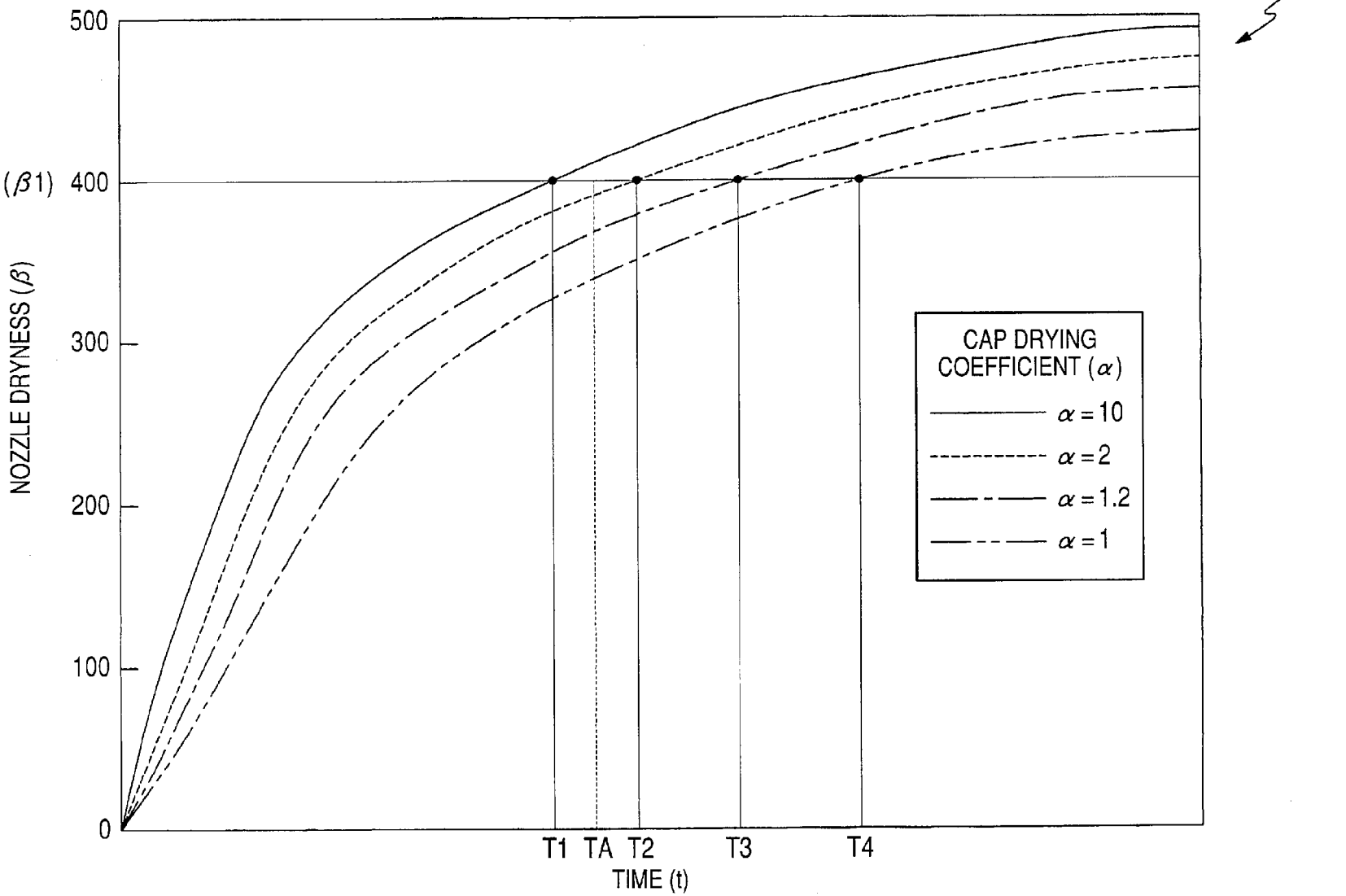
FIG. 5 is a diagram schematically showing a configuration of flushing cycle graphical data.

The ROM 22 stores a cap drying coefficient table 22*a* (see FIG. 4A), a nozzle dryness table 22*b* (see FIG. 4B), and flushing cycle graphical data 22*c* (see FIG. 5). The cap drying coefficient table 22*a* is a data table used for reading out a cap drying coefficient α based on a value in an uncapped time memory 23*b* described later. The nozzle dryness table 22*b* is a data table used for reading out a nozzle dryness β based on the cap drying coefficient α and a non-printing state time. The cap drying coefficient α is a numerical value (coefficient) indicating the degree of dryness inside the suction cap 72. The nozzle dryness β is a numerical value indicating the degree of dryness (dryness level) of the nozzles of the print head 65.

The flushing cycle graphical data 22*c* is graphical data used for predicting a time interval T (hereinafter referred to as the "flushing interval T") between a latest periodic flushing process and a next periodic flushing process (S27 in FIG. 6), based on a cap drying coefficient α and a dryness limit value β1 (see FIG. 5). The dryness limit value β1 is a predetermined numerical value (a predetermined level) in the nozzle dryness β. For example, the dryness limit value β1 is selected where a periodic flushing process (S27) and a periodic purging process (S24 in FIG. 6) cannot recover the ejecting state of the nozzles of the print head 65 if the nozzle is dried to indicate the nozzle dryness β being equal to or above the dryness limit value β1. The cap drying coefficient table 22*a* and the nozzle dryness table 22*b* will be described in detail with reference to FIGS. 4A and 4B and the flushing cycle graphical data 22*c* will be described in detail with reference to FIG. 5.

The RAM 23 includes a capped time memory 23*a*, an uncapped time memory 23*b*, a drying coefficient storage memory 23*c*, a flushing time memory 23*d*, and a nozzle dryness memory 23*e*. The capped time memory 23*a* stores a start time of a non-printing state, i.e., a state (hereinafter, referred to as the "capped state") in which the nozzles of the print head 65 are sealed with the suction cap 72. When being in a capped state is verified, the CPU 21 reads out a value in the timer circuit 28 and writes the value into the capped time memory 23*a*. Thereafter, by subtracting the value in the capped time memory 23*a* from the value in the timer circuit 28, a period of time for which the capped state is continued (hereinafter, referred to as the "capped time") can be calculated. The value in the capped time memory 23*a* is set to 0 by the CPU 21 after a printing process, a periodic flushing process (S27) and a periodic purging process (S24) are performed. This is because when the printing process, the periodic flushing process (S27) and the periodic purging process (S24) are performed, ink is ejected or sucked from the nozzles of the print head 65 and thus the ejecting state of the nozzles is recovered.

The uncapped time memory 23*b* stores a time of a printing state, i.e., a state in which the nozzles of the print head 65 are exposed (hereinafter, referred to as the "uncapped state"). Here, when being in an uncapped state, the suction cap 72 is exposed to air and thus the inside of the suction cap 72 dries. As a result, the humidity of the inside of the suction cap 72 is reduced and ink adhering to the nozzles dries quickly. That is, the progression of drying of ink that adheres to the nozzles varies depending on the length of an uncapped state time (hereinafter, referred to as the "uncapped time"). To cope with this, the uncapped time memory 23*b* is provided. Based on a value in the uncapped time memory 23*b*, the dryness of the suction cap 72 can be determined. The value in the uncapped time memory 23*b* is incremented by one in a maintenance process (see FIG. 6; described later), each time being in an uncapped state is determined. Accordingly, the value in the uncapped time memory 23*b* becomes greater as the uncapped time becomes longer. The value in the uncapped time memory 23*b* is set to 0 after the periodic purging process (S24 in FIG. 6) is performed. This is because when ink is sucked from the nozzles of the print head 65 by the periodic purging process (S24), the inside of the suction cap 72 gets wet with ink, and thus, the humidity of the inside of the suction cap 72 increases.

The drying coefficient storage memory 23*c* stores a cap drying coefficient α obtained from the cap drying coefficient table 22*a* (see FIG. 4A). The cap drying coefficient α is obtained based on a value in the uncapped time memory 23*b*.

After a periodic purging process (S24) is performed, the value in the drying coefficient storage memory 23*c* is set to "1," which is a minimum value. This is because by performing a periodic purging process (S24), the inside of the suction cap 72 gets wet with ink.

The flushing time memory 23*d* stores the flushing interval T (see FIG. 5), the flushing interval T being calculated based on a cap drying coefficient α stored in the drying coefficient storage memory 23*c* and the dryness limit value β1 stored in the dryness limit value memory 24*b*, as described later. When the flushing interval T is below a time interval TA stored in the flushing interval memory 24*a* (described later), a periodic purging process (S24) is performed.

The nozzle dryness memory 23*e* stores a nozzle dryness β of the nozzles of the print head 65, which is obtained from the nozzle dryness table 22*b* (see FIG. 4B) based on a cap drying coefficient α stored in the drying coefficient storage memory 23*c* and a capped time. When the nozzle dryness β is equal to or above the dryness limit value β1, a periodic flushing process (S27) is performed. After the periodic flushing process (S27), a periodic purging process (S24) and a printing process are performed, ink is ejected or sucked from the nozzles of the print head 65, and thus, the ejecting state of the nozzles is recovered. Accordingly, the value in the nozzle dryness memory 23*e* is set to "100," which is a minimum value, after these processes are performed.

The EEPROM 24 includes a flushing interval memory 24*a* and a dryness limit value memory 24*b*. Values to be stored in the flushing interval memory 24*a* and the dryness limit value memory 24*b* can be freely set via the operation panel 3.

Figure 6:
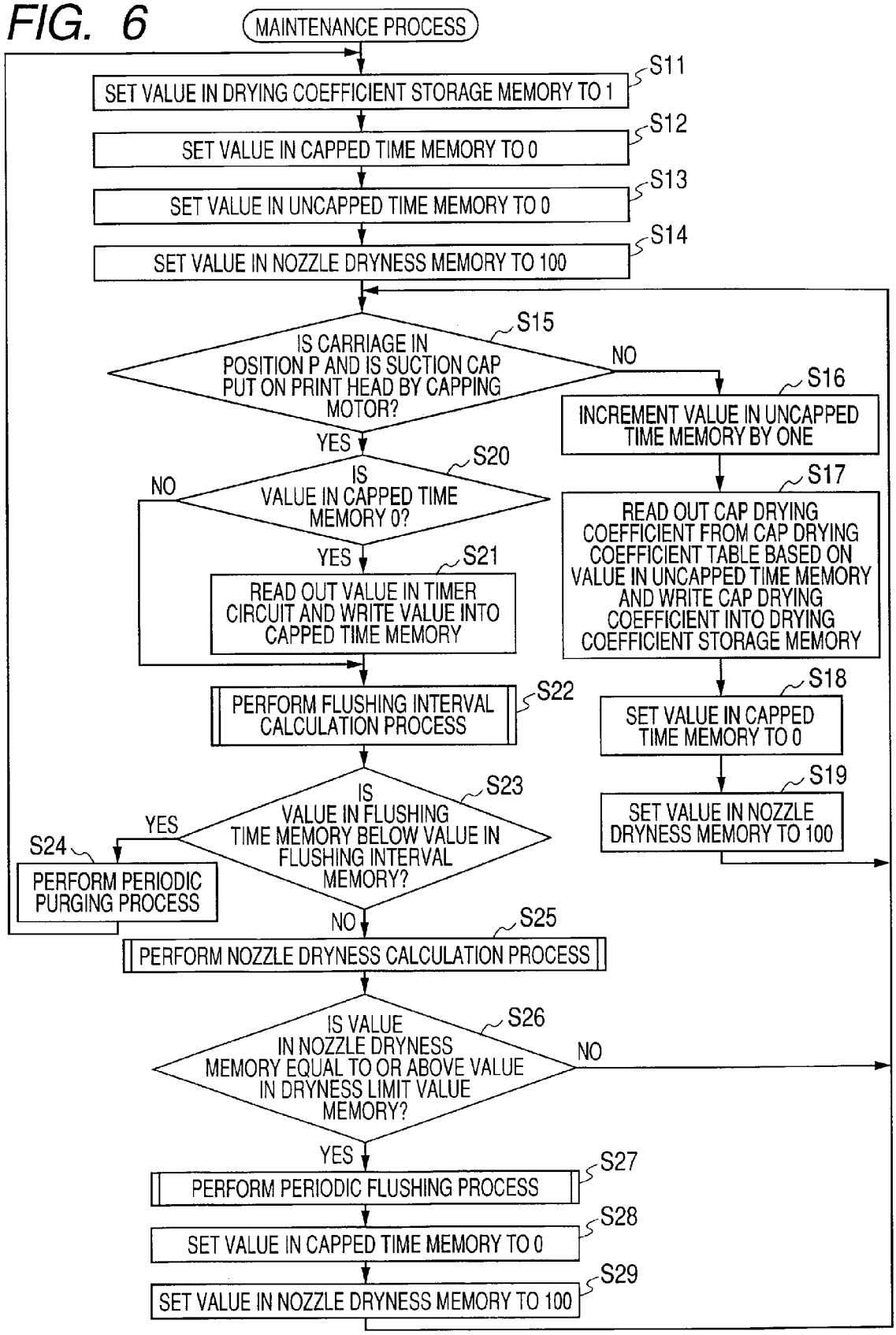
FIG. 6 is a flowchart of a maintenance process to be performed on a printer unit of the multifunction peripheral device.

The flushing interval memory 24*a* stores a minimum value of the flushing interval T between a latest periodic flushing process and a next periodic flushing process (S27 in FIG. 6). In this example, "TA" is set as the minimum value of the flushing interval T. When the flushing interval T stored in the flushing time memory 23*d* is equal to or below the minimum value TA, a periodic purging process (S24 in FIG. 6) is performed.

The dryness limit value memory 24*b* stores the dryness limit value β1 (see FIG. 5) which is an upper limit to the above-described nozzle dryness β. In the dryness limit value memory 24*b* according to this example, "400" is set as the dryness limit value β1. When a nozzle dryness β reaches "400," a periodic flushing process (S27) is performed by the CPU 21.

Next, with reference to FIGS. 4 and 4B, the cap drying coefficient table 22*a* and the nozzle dryness table 22*b* will be described. FIG. 4A is a diagram schematically showing the configuration of the cap drying coefficient table 22*a*. FIG. 4B is a diagram schematically showing the configuration of the nozzle dryness table 22*b*.

As shown in FIG. 4A, the cap drying coefficient table 22*a* includes a plurality of time ranges of the uncapped time and cap drying coefficients α associated with each of the time ranges are respectively stored. The CPU 21 reads out a cap drying coefficient α associated with a time range corresponding to a value in the uncapped time memory 23*b* from the cap drying coefficient table 22*a* and writes the cap drying coefficient α into the drying coefficient storage memory 23*c*. For example, when the value in the uncapped time memory 23*b* is "5," the CPU 21 reads out "1.2" from the cap drying coefficient table 22*a* and writes the "1.2" into the drying coefficient storage memory 23*c*. When the value in the uncapped time memory 23*b* is "55," the CPU 21 reads out "2" from the cap drying coefficient table 22*a* and writes the "2" into the drying coefficient storage memory 23*c*. That is, any one of the values "1," "1.2," "2," and "10" is stored in the drying coefficient storage memory 23*c* based on the value in the uncapped time memory 23*b*.

As shown in FIG. 4B, the nozzle dryness table 22*b* includes a plurality of time ranges of the capped time for each cap drying coefficient α and nozzle dryness β associated with each of the time ranges are respectively stored. The CPU 21 reads out a nozzle dryness β corresponding to the cap drying coefficient α stored in the drying coefficient storage memory 23*c* and the calculated capped time and writes the nozzle dryness β into the nozzle dryness memory 23*e*. For example, when the value in the drying coefficient storage memory 23*c* is "1.2" and the capped time is 40 hours, the CPU 21 reads out "300" from the nozzle dryness table 22*b* and writes the "300" into the nozzle dryness memory 23*e*. When the value in the drying coefficient storage memory 23*c* is "10" and the capped time is 40 hours, the CPU 21 reads out "400" from the nozzle dryness table 22*b* and writes the "400" into the nozzle dryness memory 23*e*. The value in the dryness limit value memory 24*b* according to this example is set to "400" and when the value written into the nozzle dryness memory 23*e* is equal to or above "400," a periodic flushing process (S27 in FIG. 6) is performed. A capped time is calculated by subtracting a value in the capped time memory 23*a* from a value in the timer circuit 28.

Next, with reference to FIG. 5, the flushing cycle graphical data 22*c* will be described. FIG. 5 is a diagram schematically showing the configuration of the flushing cycle graphical data 22*c*. As shown in FIG. 5, the flushing cycle graphical data 22*c* shows nozzle dryness (β)–time (t) characteristics respectively associated with the drying coefficients, more particularly, the relationship between the nozzle dryness β and elapsed time t from a time point at which the nozzle dryness β is 0. A horizontal axis in FIG. 5 (a left-right direction in FIG. 5) indicates the elapsed time t from a time point at which the nozzle dryness β is 0 and a vertical axis in FIG. 5 (an up-down direction in FIG. 5) indicates the nozzle dryness β.

Four graphs shown in FIG. 5 each are a graph of a function represented by "β=f(α,t)." In the graphs in FIG. 5, a solid line represents a graph of "α=10," a dotted line represents a graph of "α=2," a dash-dotted line represents a graph of "α=1.2" and a dash-double-dotted line represents a graph of "α=1."

The "β1" in FIG. 5 indicates the dryness limit value β1 stored in the dryness limit value memory 24*b*. Since the dryness limit value memory 24*b* according to this example is set to "400" by a user, "β1=400." In a flushing interval calculation process (S22 in FIG. 6), the flushing interval T between a latest periodic flushing process and a next periodic flushing process (S27) is predicted by the CPU 21. The flushing interval T to be predicted is calculated by finding the intersection point of graphs of "β1=400" and "β=f(α,t)." That is, by substituting "α" and "β=400" for the function "β=f(α, t)," the flushing time T to be predicted is calculated. The calculated flushing interval T is stored in the flushing time memory 23*d*. The flushing interval T to be predicted is "T4" when "α=1," "T3" when "α=1.2," "T2" when "α=2" and "T2" when "α=10."

The flushing interval T has "T1" as a minimum and increases in the order of "T1," "T2," "T3" and "T4." Accordingly, the longer the uncapped time, the flushing interval T to be predicted will be calculated to a smaller time interval. This is because the longer the uncapped time, the dryer the inside of the suction cap 72 and the humidity thereof is reduced, and consequently, ink adhering to the nozzles dries quickly.

When the value in the uncapped time memory 23*b* increases, the cap drying coefficient α becomes "10." In such a case, the flushing interval T to be predicted is "T1" and the value of the "T1" is below the values of "T2" to "T4." Thus, a periodic flushing process (S27) is more frequently performed than the case of "T2" to "T4" and it is predicted that ink consumption increases. To prevent this, the flushing interval memory 24*a* (see FIG. 3) stores therein the time interval "TA" which is the minimum value of the flushing interval T between a latest periodic flushing process and a next periodic flushing process (S27). As described above, when the flushing interval T stored in the flushing time memory 23*d* is equal to or below the time interval "TA," the CPU 21 performs a periodic purging process (S24). The time interval "TA" in this example is set to a value above "T1" and below "T2." That is, when the flushing interval T is predicted to be "T1," a periodic purging process (S24 in FIG. 6) is performed. When the periodic purging process (S24) is performed, the inside of the suction cap 72 gets wet with ink and thus the humidity of the inside of the suction cap 72 increases. By this, drying of ink adhering to the nozzles of the print head 65 can be suppressed. Accordingly, since a periodic flushing process (S27) does not need to be performed frequently, the CPU 21 sets the values in the capped time memory 23*a* and the uncapped time memory 23*b* to 0, sets the value (the cap drying coefficient α) in the drying coefficient storage memory 23*c* to "1" and further sets the value (the nozzle dryness β) in the nozzle dryness memory 23*e* to "100." As a result, the flushing interval T is calculated to be "T4," and thus, the flushing interval T to be predicted is longer, and consequently, ink consumption can be suppressed.

Next, with reference to flowcharts of FIG. 6 to FIG. 9, a maintenance process to be performed on the multifunction peripheral device 1 according to this example will be described. FIG. 6 is a flowchart of a maintenance process to be performed on the printer unit PU of the multifunction peripheral device 1. In the maintenance process in FIG. 6, first, the value in the drying coefficient storage memory 23*c* is set to "1" (S11). Next, the value in the capped time memory 23*a* is set to 0 (S12), the value in the uncapped time memory 23*b* is set to 0 (S13), and the value in the nozzle dryness memory 23*e* is set to "100" (S14). Then, it is verified whether the carriage 66 is in the position P and the suction cap 72 is put on the print head 65 by the capping motor 75 (S15). That is, the process of S15 is a process of verifying whether it is in a capped state (a non-printing state) or an uncapped state (a printing state). When the carriage 66 is in the position P and the suction cap 72 is not put on the print head 65 by the capping motor 75 (S15: No), it is in an uncapped state, and thus, the value in the uncapped time memory 23*b* is incremented by one (S16). Then, based on the value in the uncapped time memory 23*b*, a cap drying coefficient α is read out from the cap drying coefficient table 22*a* and the cap drying coefficient α is written into the drying coefficient storage memory 23*c* (S17, see FIG. 4A). Then, the value in the capped time memory 23*a* is set to 0 (S18) and the value in the nozzle dryness memory 23*e* is set to "100" (S19). Then, the process proceeds to S15 and the processes of S15 to S19 are repeated until a capped state (a non-printing state) is verified.

On the other hand, when the carriage 66 is in the position P and the suction cap 72 is put on the print head 65 by the capping motor 75 (S15: Yes), a capped state is verified and thus it is verified whether the value in the capped time memory 23*a* is 0 (S20). If the value in the capped time memory 23*a* is 0 (S20: Yes), then, the value in the timer circuit 28 is read out to store a start time of the capped state and that value is written into the capped time memory 23*a* (S21). Then, a flushing interval calculation process (S22) is performed. On the other hand, if the value in the capped time memory 23*a* is not "0" (No: S20), the capped state is continued and thus the process proceeds to S22.

Figure 7:
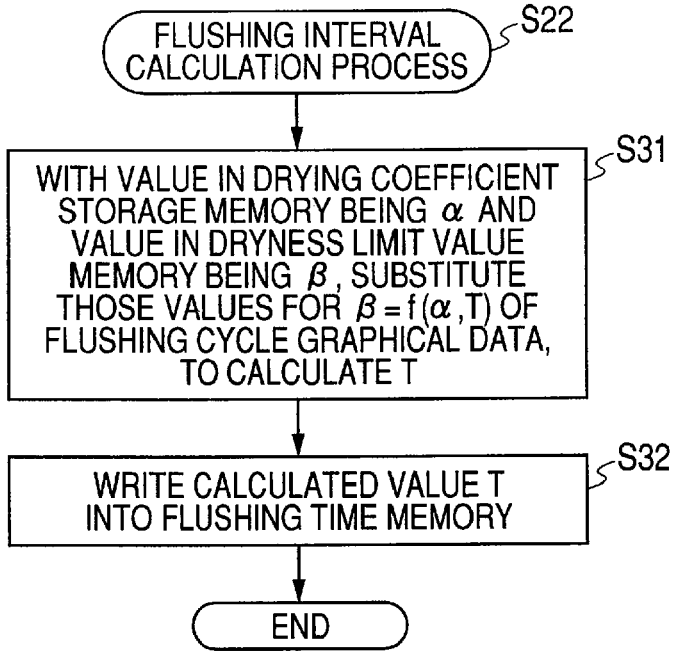
FIG. 7 is a flowchart of a flushing interval calculation process to be periodically performed on the printer unit of the multifunction peripheral device.

Now, with reference to FIG. 7, the flushing interval calculation process (S22) will be described. FIG. 7 is a flowchart of the flushing interval calculation process (S22) to be periodically performed on the printer unit PU of the multifunction peripheral device 1. In the flushing interval calculation (S22) in FIG. 7, first, with the value in the drying coefficient storage memory 23*c* being α and the value in the dryness limit value memory 24*b* being β, those values are substituted for the function "β=f(α,t)" of the flushing cycle graphical data 22*c* (see FIG. 5), whereby a flushing interval T between a latest flushing process and a next flushing process is calculated (S31). Then, the calculated value T is written into the flushing time memory 23*d* (S32). For example, when the calculated value is "T3," the "T3" is written into the flushing time memory 23*d*.

Referring back to FIG. 6, after the flushing interval calculation process (S22) is performed, it is verified whether the value in the flushing time memory 23*d* is below the value TA in the flushing interval memory 24*a* (S23). If the value in the flushing time memory 23*d* is below the value TA in the flushing interval memory 24*a* (S23: Yes), then aperiodic purging process (S24) is performed. For example, when the value is "T1," the value is below the value "TA" in the flushing interval memory 24*a* and thus a periodic purging process (S24) is performed.

The periodic purging process (S24) includes driving the purge motor 80 for a predetermined period of time to activate a suction pump (not shown). By this process, ink is sucked from the nozzles of the print head 65 via the suction cap 72. Hence, by performing the periodic purging process (S24), the ejecting state of the nozzles is recovered and the inside of the suction cap 72 can get wet. Then, the process proceeds to S11 and the processes starting from S11 are repeated. On the other hand, if the value in the flushing time memory 23*d* is not below the value TA in the flushing interval memory 24*a* (S23: No), then a nozzle dryness calculation process (S25) is performed.

Figure 8:
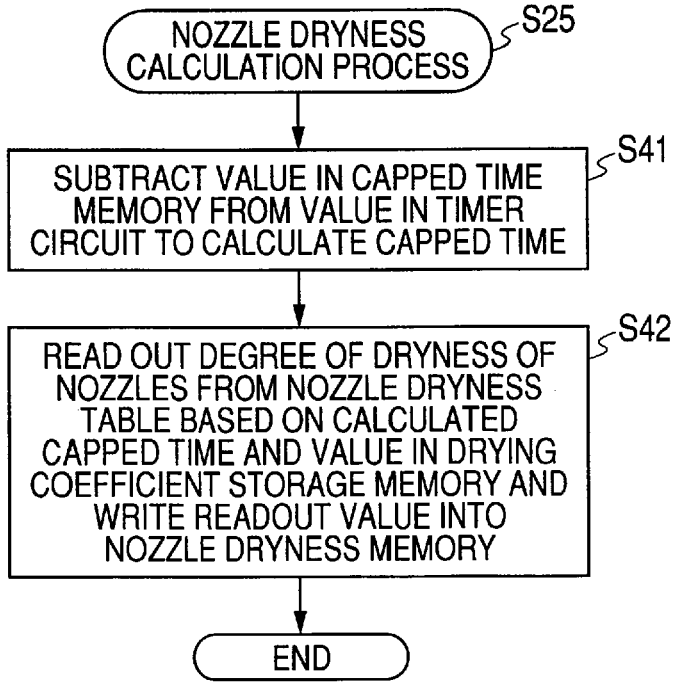
FIG. 8 is a flowchart of a nozzle dryness calculation process to be periodically performed on the printer unit of the multifunction peripheral device.

Now, with reference to FIG. 8, the nozzle dryness calculation process (S25) will be described. FIG. 8 is a flowchart of the nozzle dryness calculation process (S25) to be periodically performed on the printer unit PU of the multifunction peripheral device 1. In the nozzle dryness calculation process (S25) in FIG. 8, first, the value in the capped time memory 23*a* is subtracted from the value in the timer circuit 28, whereby a capped time is calculated (S41). Then, based on the calculated capped time and the value (the cap drying coefficient α) in the drying coefficient storage memory 23*c*, a nozzle dryness β is read out from the nozzle dryness table 22*b* (see FIG. 4B) and the readout value is written into the nozzle dryness memory 23*e* (S42). For example, when the value in the drying coefficient storage memory 23*c* is "1.2" and the capped time is 40 hours, "300" is read out as the nozzle dryness. Then, "300" is written into the nozzle dryness memory 23*e*.

Referring back to FIG. 6, after the nozzle dryness calculation process (S25) is performed, it is verified whether the value in the nozzle dryness memory 23*e* is equal to or above the value in the dryness limit value memory 24*b* (S26). If the value in the nozzle dryness memory 23*e* is not equal to or above the value in the dryness limit value memory 24*b* (S26: No), then the process proceeds to S15 and the processes starting from S15 are repeated. On the other hand, if the value in the nozzle dryness memory 23*e* is equal to or above the value in the dryness limit value memory 24*b* (S26: Yes), then a periodic flushing process (S27) is performed.

Figure 9:
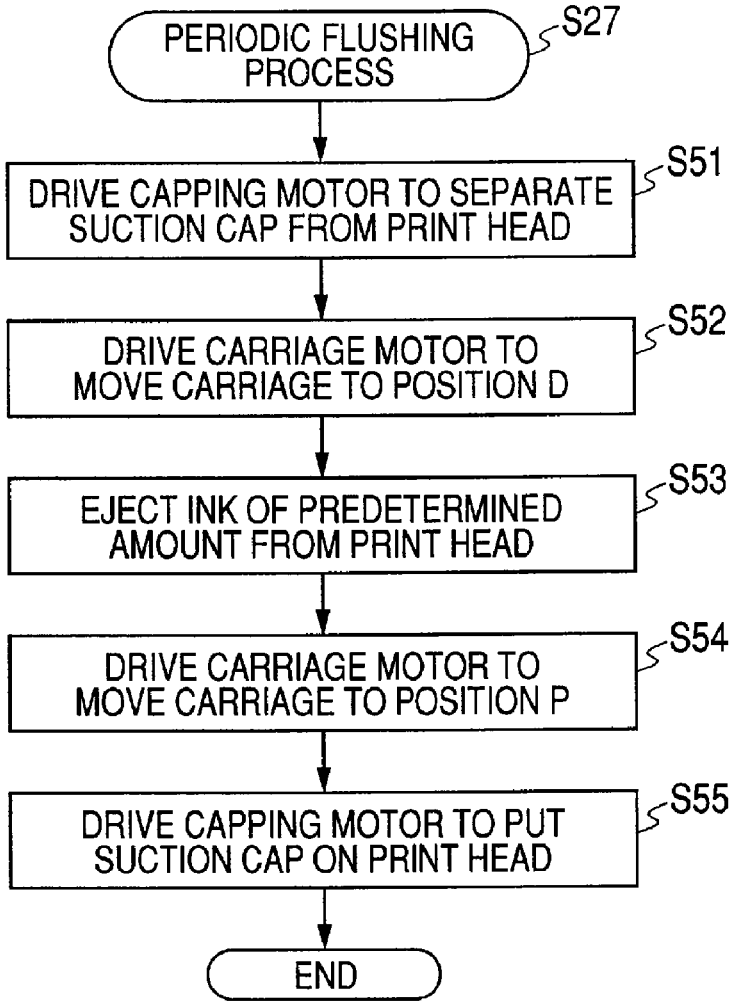
FIG. 9 is a flowchart of a periodic flushing process to be periodically performed on the printer unit of the multifunction peripheral device.

Now, with reference to FIG. 9, the periodic flushing process (S27) will be described. FIG. 9 is a flowchart of the periodic flushing process (S27) to be periodically performed on the printer unit PU of the multifunction peripheral device 1. In the periodic flushing process (S27) in FIG. 9, first, the capping motor 75 is driven to separate the suction cap 72 from the print head 65 (S51). Then, the carriage motor 67 is driven to move the carriage 66 to the position D (see FIG. 2) (S52) and ink of a predetermined amount is ejected from the nozzles of the print head 65 (S53). Then, the carriage motor 67 is driven to move the carriage 66 to the position P (see FIG. 2) (S54) and the capping motor 75 is driven to put the suction cap 72 on the print head 65 (S55). Accordingly, the ejecting state of the nozzles of the print head 65 can be recovered.

Referring back to FIG. 6, after the periodic flushing process (S27) is performed, the value in the capped time memory 23*a* is set to "0" (S28), the value in the nozzle dryness memory 23*e* is set to "100" (S29), and the process proceeds to S15. Then, the processes starting from S15 are repeated.

According to the multifunction peripheral device 1 of this example, a capped time is calculated by subtracting a value in the capped time memory 23*a* from a value in the timer circuit 28, and an uncapped time is timed by the uncapped time memory 23*b*. Then, based on a value in the uncapped time memory 23*b*, a cap drying coefficient $\alpha$ is obtained from the cap drying coefficient table 22*a*. Based on the obtained cap drying coefficient $\alpha$ and the capped time, a nozzle dryness $\beta$ is obtained from the nozzle dryness table 22*b*. When the obtained nozzle dryness $\beta$ is equal to or above the dryness limit value $\beta$1, the periodic flushing process (S27) is performed to eject ink from the nozzles of the print head 65, whereby the ejecting state of the nozzles is recovered.

Hence, since the nozzle dryness $\beta$ based on the capped time and the uncapped time can be appropriately obtained, when the nozzle dryness $\beta$ reaches the dryness limit value $\beta$1, the periodic flushing process (S27) can be performed. Thus, even if the suction cap 72 is exposed to air and the inside thereof dries, when the nozzle dryness reaches a predetermined dryness, the ejecting state of the nozzles can be recovered. Accordingly, appropriate timing for recovering the ejecting state of the nozzles of the print head 65 can be detected. In addition, since appropriate timing for recovering the ejecting state of the nozzles of the print head 65 can be detected, there is no need to excessively shorten the interval of performing the periodic flushing process (S27) and frequently perform the periodic flushing process (S27), to prevent ejecting failure. Consequently, ink consumption can be suppressed.

According to the multifunction peripheral device 1 of this example, a flushing interval T between a latest periodic flushing process and a next flushing process is predicted based on a cap drying coefficient $\alpha$ obtained from the cap drying coefficient table 22*a* and a dryness limit value $\beta$1 stored in the dryness limit value memory 24*b*. When the predicted flushing interval T is equal to or below the minimum value TA stored in the flushing time memory 23*d*, the purge motor 80 is driven in the capped state and ink is sucked from the nozzles via the suction cap 72. Accordingly, the inside of the suction cap 72 gets wet with ink, and thus, the humidity of the inside of the suction cap 72 increases. Consequently, drying of ink adhering to the nozzles in a capped state can be suppressed.

As an operation of a first timer unit that times a sealing time, the process of S21 by the CPU 21 shown in FIG. 6 and the calculation process of S41 by the CPU 21 shown in FIG. 8 can be exemplified. As an operation of a second timer unit that times an exposing time, the process of S16 shown in FIG. 6 can be exemplified. As an operation of a dryness obtaining unit, the nozzle dryness calculation process shown in FIG. 6 and FIG. 8 and the process of S17 by the CPU 21 can be exemplified. As an operation of a control unit, the determination process of S26 and the process of S27 which are shown in FIG. 6 can be exemplified. As an operation of an interval calculating unit, a flushing interval calculation process shown in FIG. 6 and FIG. 7 can be exemplified. As an operation of a purging unit corresponds to the determination process of S23 and the periodic purging process which are shown in FIG. 6 can be exemplified.

In an inkjet printer according to an example, the first timer unit times a sealing time when the sealing unit seals the nozzle of the print head, and the second timer unit times an exposing time when the sealing unit seals the nozzle. The dryness obtaining unit obtains a dryness level of the nozzle based on the exposing time and the sealing time. When the obtained dryness level is equal to or above a limit level stored in the limit level storing unit, the maintenance unit is activated by the control unit to perform a maintenance operation to recover an ejection state of the nozzle, and the maintenance operation includes at least one of ejecting the ink through the nozzle and sucking ink from the nozzle.

As such, a dryness level of the nozzle based on a sealing time and an exposing time is obtained and when the dryness level reaches the limit level, the maintenance unit is activated. Thus, even if the sealing unit is exposed to air and the inside thereof dries, when the dryness level of the nozzle reaches a predetermined level, the ejecting state of the nozzle can be recovered. Accordingly, there is an advantageous effect that appropriate timing for recovering the ejecting state of the nozzle can be detected. In addition, since appropriate timing for recovering the ejecting state of the nozzle can be detected, there is no need to shorten the interval of activating the maintenance unit and frequently activate the maintenance unit, to prevent ejecting failure. Consequently, there is an advantageous effect that ink consumption can be suppressed.

In the inkjet printer, the drying coefficient obtaining unit may obtain, based on the exposing time, a drying coefficient from drying coefficients that are stored in the drying coefficient storing unit to be associated with a plurality of ranges of exposing time. Accordingly, there is an advantageous effect that the dryness obtaining unit can appropriately obtain the dryness level of the nozzle based on the one drying coefficient obtained by the drying coefficient obtaining unit and the sealing time.

In the inkjet printer, the drying coefficient may be obtained by the drying coefficient obtaining unit, based on the exposing time, from the drying coefficients that are stored in the drying coefficient storing unit to be associated with the plurality of ranges of exposing time. In addition, the dryness obtaining unit may obtain, based on the drying coefficient obtained by the drying coefficient obtaining unit and a sealing time, a dryness level from a plurality of dryness levels that are stored in the dryness storing unit to be associated with a plurality of time ranges for each drying coefficient. Accordingly, since the dryness obtaining unit can obtain, based on the sealing time, a dryness level for one drying coefficient which is based on the exposing time, there is an advantageous effect that the nozzle dryness can be appropriately obtained.

In the inkjet printer, when the dryness level obtained by the dryness obtaining unit is equal to or above the limit level stored in the limit level storing unit, the control unit may perform a flushing operation to eject ink from the nozzle of the print head and thereby recovers the ejecting state of the nozzle. That is, there is an advantageous effect that the ejecting state of the nozzle can be recovered by the flushing operation.

In the inkjet printer, the interval calculating unit calculates an interval a latest flushing operation and a next flushing operation based on the drying coefficient obtained by the drying coefficient obtaining unit and the limit level stored in the limit level storing unit. When the interval calculated by the interval calculating unit is equal to or above a minimum interval stored in the minimum interval storing unit, the purging unit activates the sucking unit to suck ink from the nozzle through the sealing unit, with the nozzle being sealed with the sealing unit. Accordingly, the inside of the sealing unit gets wet with ink, and thus, the humidity of the inside of the sealing unit increases. Consequently, there is an advantageous effect that when the nozzle is sealed with the sealing unit, drying of ink adhering to the nozzle can be suppressed.

Although the present invention has been described above based on the above example, it is understood that the present invention is not limited to the example and various modifications and alterations may be made to the example without departing from the spirit and scope of the present invention.

For example, although, in the above-described example, a value (a dryness limit value β1) in the dryness limit value memory 24*b* is set to "400," the value may be set to "300" depending on the location where the multifunction peripheral device 1 is used. In such a case, even in weather conditions where the temperature is high and the humidity is low and thus ink dries quickly, the ejecting state of the nozzles of the print head 65 can be maintained.

Although, in the above-described example, the values in the flushing interval memory 24*a* and the dryness limit value memory 24*b* are freely set via the operation panel 3, those values may be fixed values. In such a case too, when a nozzle dryness β reaches the dryness limit value β1, a periodic flushing process (S27) can be performed. Thus, even if the suction cap 72 is exposed to air and the inside of the suction cap 72 dries, when the nozzles reach a predetermined dryness, the ejecting state of the nozzles can be recovered.

What is claimed is:

1. An inkjet printer comprising: a print head that includes a nozzle and ejects ink through the nozzle; a maintenance unit that performs a maintenance operation to recover an ejection state of the nozzle, the maintenance operation including at least one of ejecting the ink through the nozzle and sucking the ink from the nozzle; a sealing unit that selectively exposes and seals the nozzle; a first timer unit that measures a sealing time when the sealing unit seals the nozzle; a second timer unit that measures an exposing time when the sealing unit exposes the nozzle; a dryness obtaining unit that obtains a dryness level of the nozzle based on the sealing time and the exposing time; a limit level storing unit that stores a predetermined dryness level as a limit level; and a control unit that activates the maintenance unit when the obtained dryness level is equal to or above the limit level and further comprising: a drying coefficient storing unit that stores a plurality of drying coefficients in association with the exposing time; and a drying coefficient obtaining unit that obtains one of the drying coefficients corresponding to the exposing time from the drying coefficient storing unit, wherein the dryness obtaining unit obtains the dryness level based on the obtained drying coefficient and the sealing time.

2. The inkjet printer according to claim 1, wherein: the drying coefficient storing unit stores the plurality of drying coefficients in association with a plurality of ranges of the exposing time; and the drying coefficient obtaining unit obtains one of the drying coefficients corresponding to one of the time ranges of the exposing time.

3. The inkjet printer according to claim 1, further comprising: a dryness storing unit that stores a plurality of dryness levels for each of the drying coefficients, in association with the sealing time, wherein the dryness obtaining unit obtains one of the dryness levels corresponding to the obtained drying coefficient and the sealing time.

4. The inkjet printer according to claim 3, wherein:

the dryness storing unit stores the plurality of dryness levels for each of the drying coefficients, in association with a plurality of ranges of the sealing time; and the dryness level obtaining unit obtains one of the dryness levels corresponding to the obtained drying coefficient and one of the time ranges of the sealing time.

5. The inkjet printer according to claim 1, wherein when the obtained dryness level is equal to or above the limit level, the control unit activates the maintenance unit to perform a flushing operation that includes ejecting the ink from the nozzle.

6. The inkjet printer according to claim 5, wherein the first timer unit resets the sealing time when the flushing operation is performed.

7. The inkjet printer according to claim 1, further comprising: a sucking unit that is provided in the maintenance unit and sucks the ink from the nozzle through the sealing unit while the sealing unit seals the nozzle; an interval calculating unit that calculates a flushing interval between a latest flushing operation and a next flushing operation based on the drying coefficient obtained by the drying coefficient obtaining unit and the limit level stored in the limit level storing unit; a minimum interval storing unit that stores a predetermined interval as a minimum interval of the flushing interval; and a purging unit that activates the sucking unit to suck the ink from the nozzle through the sealing unit, when the flushing interval calculated by the interval calculating unit is equal to or below the minimum interval stored in the minimum interval storing unit.

8. The inkjet printer according to claim 7, further comprising a dryness characteristic storing unit that stores a plurality of dryness-time characteristics in association with the plurality of drying coefficients, wherein the interval calculating unit references the plurality of dryness-time characteristics and obtains the flushing interval based on the obtained drying coefficient and the limit level.

9. The inkjet printer according to claim 7, wherein the second timer unit accumulates the exposing time during an interval of activations of the sucking unit and resets the exposing time when the sucking unit is activated.

10. A maintenance method of an inkjet printer including: a print head that includes a nozzle and ejects ink through the nozzle; and a sealing unit selectively exposing and sealing the nozzle, the maintenance method comprising: measuring a sealing time when the sealing unit seals the nozzle; measuring a exposing time when the sealing unit exposes the nozzle; obtaining a dryness level of the nozzle based on the sealing time and the exposing time; performing a maintenance operation to recover an ejection state of the nozzle when the obtained dryness level is equal to or above a predetermined dryness level, the maintenance operation including at least one of ejecting the ink through the nozzle and sucking the ink from the nozzle, wherein said obtaining the dryness level comprising: accessing a drying coefficient storing unit that stores a plurality of drying coefficients in association with the exposing time: obtaining one of the coefficients corresponding to the exposing time from the drying coefficient storing unit; and obtaining the dryness level based on the obtained drying coefficient and the sealing time.

11. The maintenance method according to claim 10, wherein said performing the maintenance operation comprises performing a flushing operation that includes ejecting the ink from the nozzle when the obtained dryness level is equal to or above the predetermined dryness level.

12. The maintenance method according to claim 11, wherein the inkjet printer includes a sucking unit that sucks the ink from the nozzle through the sealing unit while the sealing unit seals the nozzle, the maintenance method further comprising: calculating a flushing interval between a latest flushing operation and a next flushing operation based on the obtained drying coefficient and the predetermined dryness level; and activating the sucking unit to suck the ink from the nozzle through the sealing unit, when the calculated flushing interval is equal to or below a predetermined interval.

* * * * *